US012507784B2

(12) United States Patent
Byeon

(10) Patent No.: US 12,507,784 B2
(45) Date of Patent: Dec. 30, 2025

(54) STICK CONTENT CONTAINER

(71) Applicant: KR CO., LTD., Bucheon-si (KR)

(72) Inventor: Jae Sam Byeon, Gyeonggi-do (KR)

(73) Assignee: KR CO., LTD., Bucheon-si (KR)

( * ) Notice: Subject to any disclaimer, the term of this patent is extended or adjusted under 35 U.S.C. 154(b) by 10 days.

(21) Appl. No.: 18/653,573

(22) Filed: May 2, 2024

(65) Prior Publication Data

US 2024/0365952 A1 Nov. 7, 2024

(30) Foreign Application Priority Data

May 2, 2023 (KR) ..... 10-2023-0057118
Aug. 31, 2023 (KR) ..... 10-2023-0115613

(51) Int. Cl.

| | |
|---|---|
| ***A45D 40/06*** | (2006.01) |
| ***A45D 40/14*** | (2006.01) |
| ***A45D 40/18*** | (2006.01) |
| ***B65D 83/761*** | (2025.01) |

(52) U.S. Cl.

CPC ..... *A45D 40/06* (2013.01); *A45D 40/14* (2013.01); *A45D 40/18* (2013.01); *B65D 83/761* (2025.01)

(58) Field of Classification Search

CPC ..... A45D 40/18; A45D 40/06; A45D 40/00; A45D 2040/0006; A45D 40/02; A45D 40/04; A45D 40/14; A45D 40/205; A45D 2040/208; B65D 83/0011; B65D 83/0005; B65D 83/761

USPC ..... 401/68, 75–77, 87, 88, 171–174

See application file for complete search history.

(56) References Cited

U.S. PATENT DOCUMENTS

| | | | | |
|---|---|---|---|---|
| 11,076,679 | B1 * | 8/2021 | Chung | A45D 40/06 |
| 2023/0107286 | A1 * | 4/2023 | Lee | A45D 40/14 401/78 |
| 2023/0180916 | A1 * | 6/2023 | Byeon | A45D 40/06 401/108 |

* cited by examiner

*Primary Examiner* — David J Walczak

(74) *Attorney, Agent, or Firm* — Bridgeway IP Law Group, PLLC; Sang Ho Lee; Hyun Woo Shin

(57) ABSTRACT

A content container includes a housing in which an outlet is formed in an upper portion thereof, a manipulating part coupled to a lower portion of the housing to relatively rotate with the housing, a lifting part of which at least a portion is provided inside the housing and which vertically moves according to rotation of the manipulating part, and an operating part that is coupled to the lifting part such that an upper end thereof is spaced upward a predetermined distance from an upper end of the lifting part at a first coupling position so as to support contents together with the lifting part, wherein the operating part is exposed externally according to use of the contents and lowered from the first coupling position to a second coupling position by a user's external force applied to an exposed area.

9 Claims, 8 Drawing Sheets

STICK CONTENT CONTAINER

CROSS-REFERENCE TO RELATED APPLICATION

This application claims priority to and the benefit of Korean Patent Application Nos. 10-2023-0057118 filed on May 2, 2023, and 10-2023-0115613 filed on Aug. 31, 2023, the disclosures of which are incorporated herein by reference in its entirety.

BACKGROUND

1. Field of the Invention

The present disclosure relates to a content container, and more particularly to a content container configured to house stick-shaped cosmetic content.

2. Discussion of Related Art

In general, cosmetic containers are structured to accommodate various types of cosmetics and withdraw the cosmetics so that the cosmetics can be delivered to a specific part of the body. The structure of the cosmetic container may vary depending on the nature of the cosmetics accommodated in the container.

As an example, when a cosmetic is a solid cosmetic that can maintain a predetermined stick shape, such as a lipstick, a sun stick, or a sun balm, the cosmetic container partially accommodates a lower portion of a stick-shaped cosmetic therein and has a quadrangular or circular plate that supports the lower portion of the cosmetic, and the withdrawal of the cosmetic can be implemented by lifting the plate. Specifically, the conventional stick-shaped cosmetic includes an outer tube and an inner tube (or rotation manipulation part) that are provided to be relatively rotatable and may have a structure in which the plate rises when a user holds the outer tube and rotates the inner tube (or rotation manipulation part) exposed at the bottom, and thus the stick-type cosmetic rises and withdraws to the outside.

However, since the conventional stick-shaped cosmetic container with such structure is difficult to use by completely exposing the cosmetics to the outside due to the height of a plate that supports the cosmetic, there is a problem that an unusable residual amount remains.

Therefore, a new container is required to address this problem.

SUMMARY OF THE INVENTION

The present disclosure is directed to providing a stick content container that allows the contents to be used without any remaining amount by changing the position of an operating part that supports at least a part of the contents when the contents are used beyond a certain amount.

The technical problems of the present disclosure are not limited to the technical problem described above, and other technical problems not described will be clearly understood by those skilled in the art from the description below.

According to an aspect of the present disclosure, there is provided a stick content container. The stick content container includes a housing in which an outlet is formed in an upper portion thereof, a manipulating part coupled to a lower portion of the housing to relatively rotate with the housing, a lifting part of which at least a portion is provided inside the housing and which vertically moves according to rotation of the manipulating part, and an operating part that is coupled to the lifting part such that an upper end thereof is spaced upward a predetermined distance from an upper end of the lifting part at a first coupling position so as to support contents together with the lifting part, wherein the operating part is exposed externally according to use of the contents and lowered from the first coupling position to a second coupling position by a user's external force applied to an exposed area.

The operating part may include a body portion coupled to the upper end of the lifting part, and one or more wing portions that are formed to protrude outward or inward from an upper circumference of the body portion, and at least a portion of which is disposed separately upward from the upper end of the lifting part at the first coupling position, wherein the contents may be supported by the upper end of the lifting part and the wing portion at the first coupling position.

One or more accommodating grooves corresponding to the wing portions may be formed at the upper end of the lifting part, and at least portions of the wing portions at the second coupling position may be accommodated in the accommodating grooves.

A lower portion of the body portion may be inserted into and coupled to the lifting part, and the wing portions may protrude outward from the upper circumference of the body portion.

An extending protrusion may protrude downward from one area in the one or more wing portions, and a through hole into which the extending protrusion is inserted may be formed in the one or more accommodating grooves.

A first locking protrusion may be formed along a lower outer circumferential surface of the body portion, and a second locking protrusion, which is engaged with the first locking protrusion at the first coupling position, may be formed on an upper inner circumferential surface of the lifting part.

An elastic piece may be formed on the body portion by passing through an outer circumferential surface of the body portion in a predetermined shape, and a third locking protrusion, which is engaged with an upper end surface of the lifting part at the first coupling position, may be formed on a lower outer surface of the elastic piece.

When the user's external force is applied to the wing portion exposed to the outside by use of the contents, the elastic piece may be elastically deformed inward, the third locking protrusion may be separated from the upper end surface of the lifting part, and the operating part may descend to the second coupling position.

A guide protrusion may be formed along the outer circumferential surface of the lifting part, the manipulating part may include a lifting tube into which the lifting part is inserted, and one or more lifting protrusions may be formed on the inner circumferential surface, and as the manipulating part rotates, the lifting protrusion may move relative to the guide protrusion and move the lifting part upward or downward.

BRIEF DESCRIPTION OF THE DRAWINGS

In order to more fully understand the drawings cited in the detailed description of the present disclosure, a brief description of each drawing is provided.

DETAILED DESCRIPTION OF EXEMPLARY EMBODIMENTS

Figure 1:
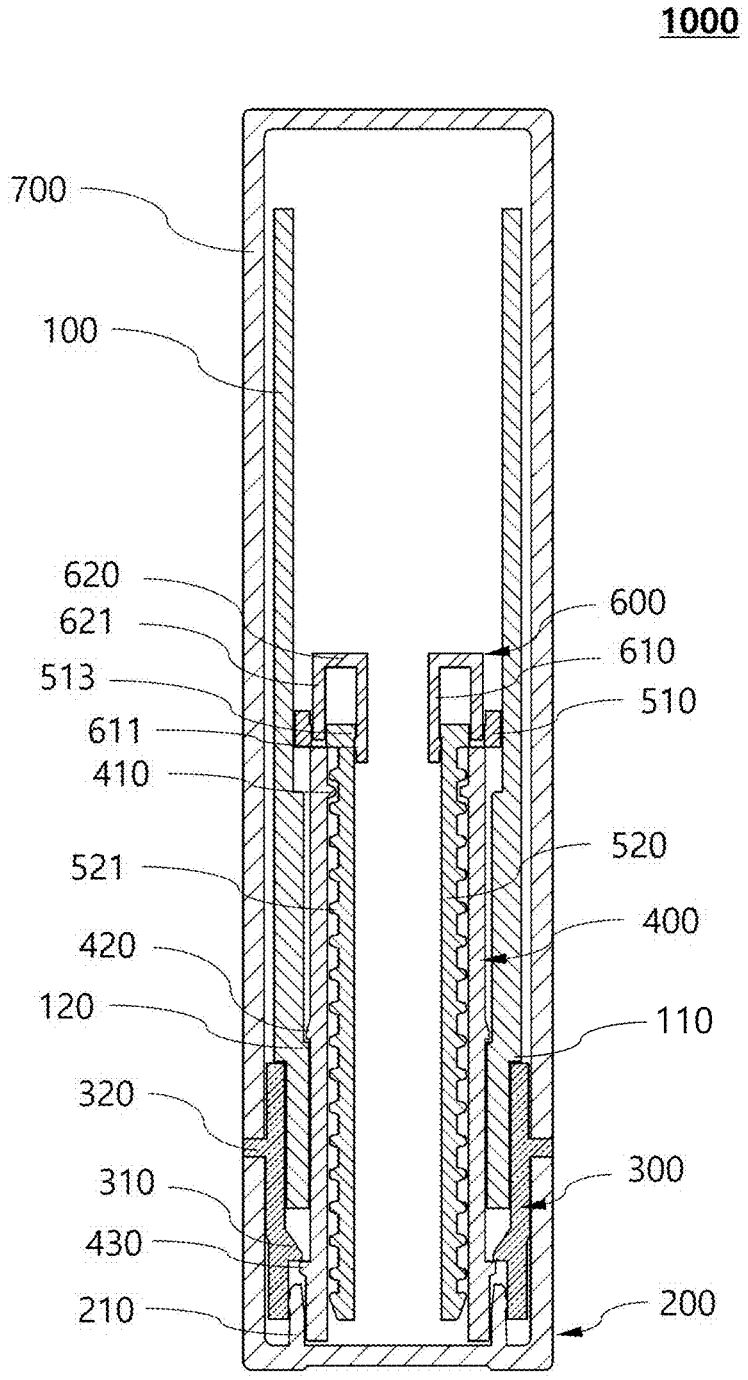
FIG. 1 is a cross-sectional view of a stick content container according to an embodiment of the present disclosure.

Hereinafter, embodiments according to the present disclosure will be described with reference to the attached drawings. When adding reference numerals to components in each drawing, it should be noted that identical components are given the same reference numerals as much as possible even when they are shown in different drawings. Additionally, when describing embodiments of the present disclosure, when detailed descriptions of related known configurations or functions are judged to impede understanding of the embodiments of the present disclosure, the detailed descriptions will be omitted. In addition, embodiments of the present disclosure will be described below, but the technical idea of the present disclosure is not limited thereto and may be modified and implemented in various ways by those skilled in the art. Meanwhile, for convenience, the up, down, left, and right directions described below are based on the drawings, and the scope of the present disclosure is not necessarily limited to those directions.

Throughout the specification, when a first part is said to be "connected" to a second part, this includes not only the case where the first part is "directly connected" to the second part, but also the case where the first part is "indirectly connected" to the second part with another element therebetween. Throughout the specification, when a part is said to "include" a certain element, this means that it may further include other elements rather than excluding other elements, unless specifically stated to the contrary. Additionally, in describing the components of the embodiment of the present disclosure, terms such as first, second, A, B, (a), and (b) may be used. These terms are only used to distinguish the component from other components, and the nature, sequence, or order of the component is not limited by the term.

Additionally, in the specification, "moving vertically" is used to encompass movement relative to other configurations in addition to absolute movement.

Figure 2:
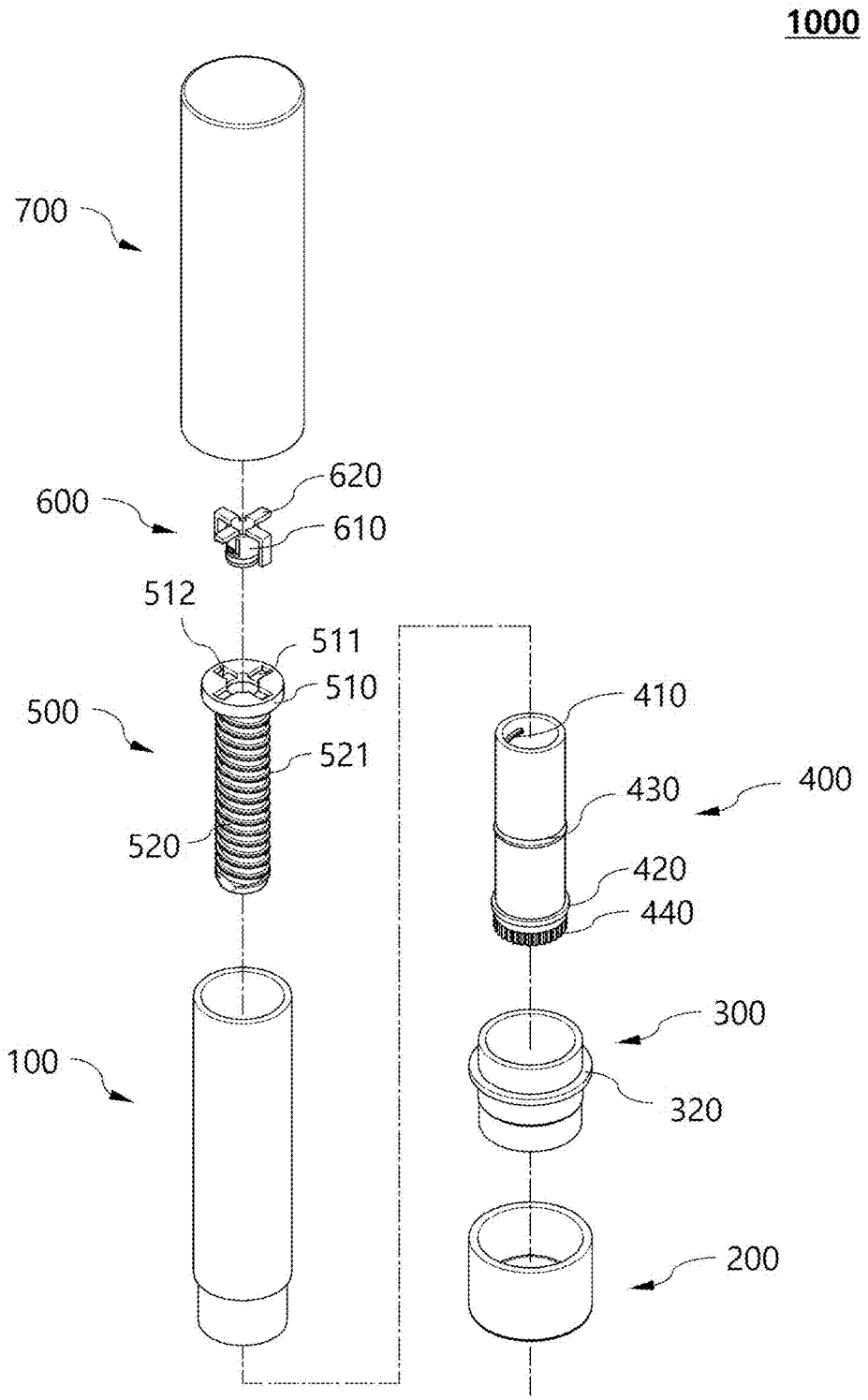
FIG. 2 is a perspective view of a stick content container according to an embodiment of the present disclosure.
Figure 3:
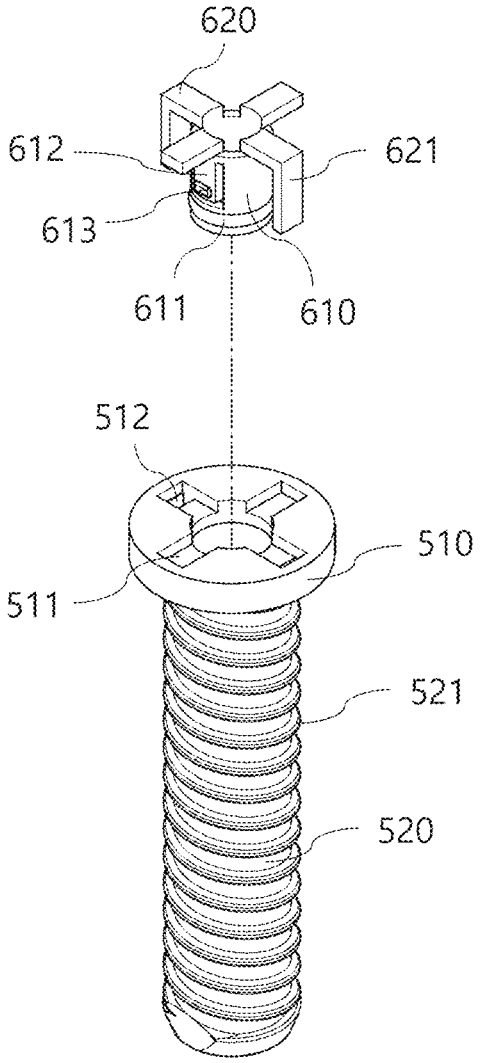
FIG. 3 is a perspective view of a lifting part and an operating part of a stick content container according to an embodiment of the present disclosure.
Figure 4A:
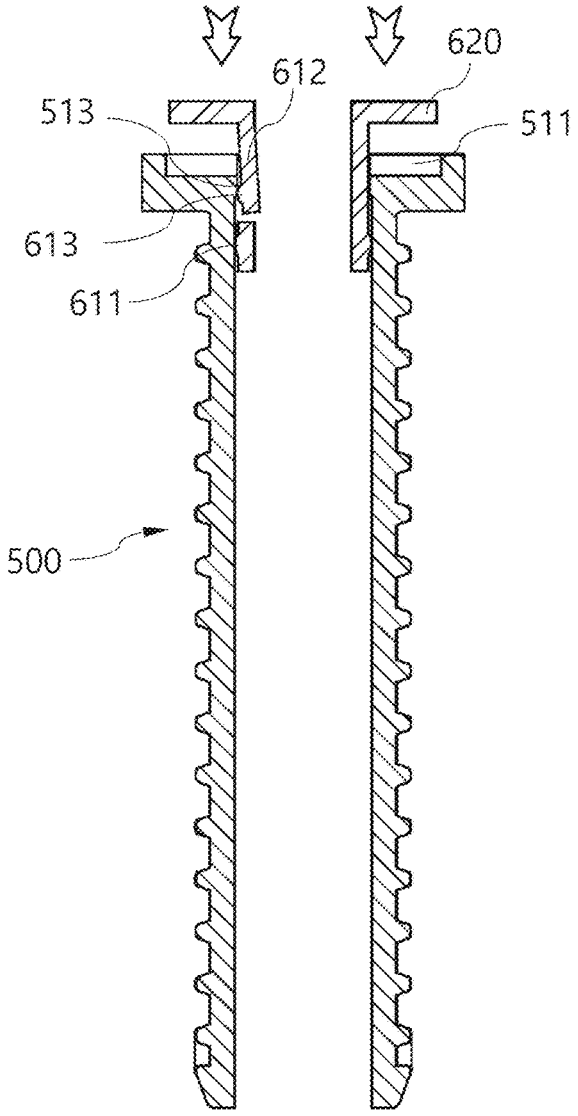
FIGS. 4A to 5B are views for explaining an operation of the operating part according to an embodiment of the present disclosure.
Figure 4B:
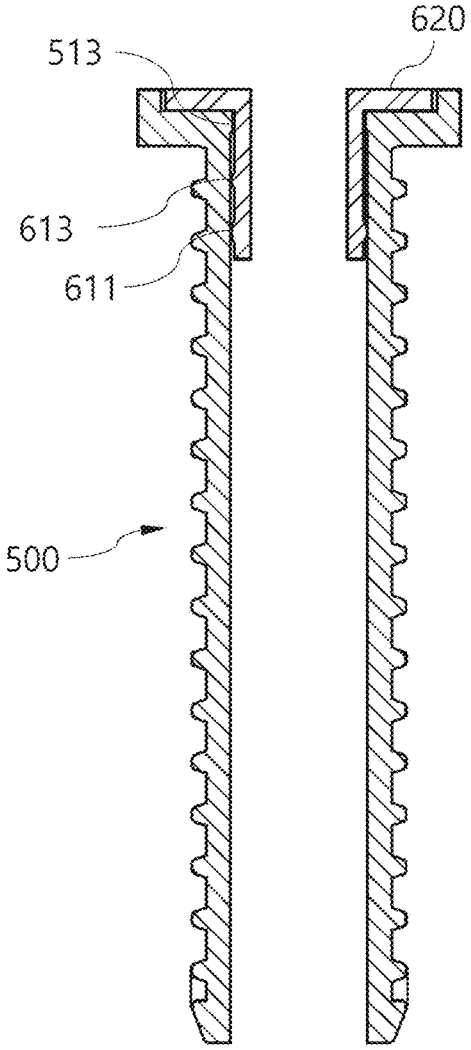
Figure 5A:
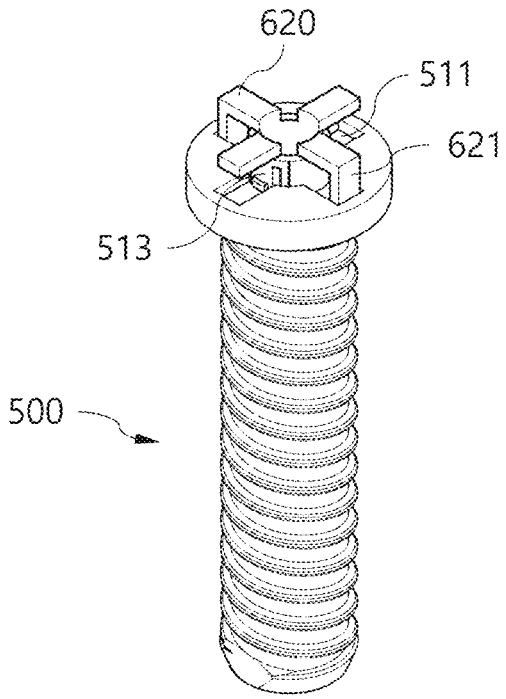
Figure 5B:
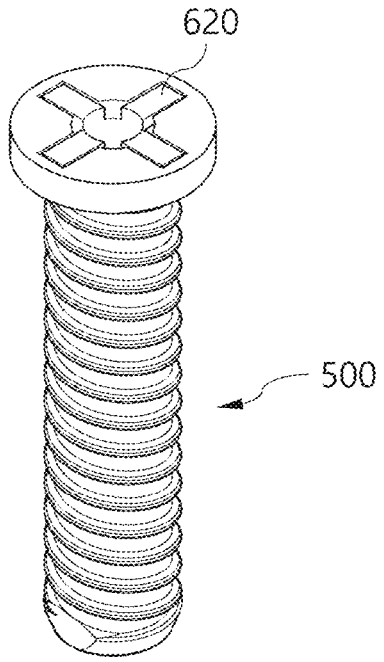

FIG. 1 is a cross-sectional view of a stick content container according to an embodiment of the present disclosure, FIG. 2 is a perspective view of the stick content container according to the embodiment of the present disclosure, and FIG. 3 is a perspective view of a lifting part and an operating part of the stick content container according to the embodiment of the present disclosure.

Referring to FIGS. 1 to 3, the stick content container 1000 may include a housing 100, manipulating parts 200, 300, and 400, a lifting part 500, an operating part 600, and an upper cap 700.

The housing 100 may accommodate contents and/or other components (a lifting tube 400, the lifting part 500, the operating part 600, etc.) therein. An upper end surface of the housing 100 is open so that an outlet (not shown) is formed in an upper portion for exposing contents to the outside. In addition, a lower portion of the housing 100 is open so that at least a portion of the lifting tube 400 and/or the lifting part 500 protrudes to the outside of the housing 100 to be connected to the manipulating parts 200, 300, and 400. Here, the contents may be solid or semi-solid cosmetics, pharmaceuticals, or quasi-drugs, but are not limited thereto. In one embodiment, the contents may be stick-shaped sunscreen, stick-type foundation, lipstick, lip balm, etc.

The housing 100 may be provided with a first stepped portion 110 and a second stepped portion 120.

The first stepped portion 110 may be formed on an outer surface of the housing 100. For example, the first stepped portion 110 may be formed by reducing an outer diameter of the lower portion of the housing 100. When the housing 100 is coupled to a rotating portion 300, the lower portion of the housing 100 (particularly, the area where an outer diameter of the lower portion of the housing 100 is reduced) is inserted into the rotating portion 300, and the first stepped portion 110 may be seated on an upper end of the rotating portion 300. However, it is not limited thereto, and in some embodiments of the present disclosure, various structures that enable relative rotation of the housing 100 and the rotating portion 300 may be applied.

The second stepped portion 120 may be formed on an inner surface of the housing 100. For example, the second stepped portion 120 may be formed by reducing an inner diameter of the lower portion of the housing 100. When the lifting tube 400 is disposed inside the housing 100, a first coupling portion 420 of the lifting tube 400 may be seated on the second stepped portion 120. However, it is not limited thereto, and in some embodiments of the present disclosure, various structures, such as a groove-protrusion structure of the second stepped portion 120 and the first coupling portion 420 of the lifting tube 400 that enables relative rotation of the housing 100 and the lifting tube 400 and a structure in which the second stepped portion 120 and the first coupling portion 420 are omitted, may be applied.

Although not shown in the drawing, one or more vertical protrusions may be formed extending in a vertical direction on an inner circumferential surface of the housing 100. Additionally, a groove engaged with the vertical protrusion formed in the housing 100 may be formed in the outer circumferential surface of a supporting part 510 of the lifting part 500. Accordingly, when the manipulating parts 200, 300, and 400 rotate, the lifting part 500 rotates relative to the manipulating parts 200, 300, and 400, thereby allowing the lifting part 500 to move vertically inside the housing 100.

The manipulating parts 200, 300, and 400 are coupled to enable relative rotation with the lower portion of the housing 100 and rotate relative to the housing 100 in a first direction or a second direction opposite to the first direction according to a user's rotation manipulation, and thus the lifting part 500 may be moved vertically.

The manipulating parts 200, 300, and 400 may include a lower cap 200, the rotating portion 300, and the lifting tube 400.

The lower cap 200 is coupled to the outside of the rotating portion 300 to enable synchronous rotation with the rotating portion 300, and the rotational force according to the user's rotation manipulation may be transmitted to the rotating portion 300 and the lifting tube 400. For example, the lower cap 200 may be formed so that the upper surface is open and coupled to surround at least a portion of the rotating portion 300 (particularly, at least a portion of a lower portion of the rotating portion 300). As a user applies a rotational force after holding an outer surface of the lower cap 200, the lower cap 200, the rotating portion 300, and the lifting tube 400, which are coupled to each other to enable synchronous rotation, may rotate together in the first or second direction.

A plurality of first vertical protrusions (not shown) that enable synchronous rotation with the rotating portion 300 may be formed on an inner circumferential surface of the lower cap 200. For example, the first vertical protrusion may extend to have a predetermined length, and the plurality of first vertical protrusions may be disposed separately along the inner circumferential surface of the lower cap 200. In this case, a plurality of second vertical protrusions (not shown) having a shape corresponding to the first vertical protrusion of the lower cap 200 may be formed on an outer circumferential surface of the rotating portion 300. In addition, by arranging the second vertical protrusion of the rotating portion 300 to be engaged between the first vertical protrusions of the lower cap 200, the lower cap 200 and the rotating portion 300 may rotate synchronously.

A coupling edge portion 210 may be formed at an inner bottom of the lower cap 200. For example, the coupling edge portion 210 may be configured to protrude upward from an inner bottom surface of the lower cap 200 to form a ring shape. The lower portion of the rotating portion 300 is inserted into a separation space between the inner circumferential surface of the lower cap 200 and the coupling edge portion 210, and a lower portion of the lifting tube 400 is inserted into the coupling edge portion 210.

A plurality of third vertical protrusions (not shown) that enable synchronous rotation with the lifting tube 400 may be formed on an inner circumferential surface of the coupling edge portion 210. For example, the plurality of third vertical protrusions formed in a vertical direction along the inner circumferential surface of the coupling edge portion 210 may be disposed separately. In this case, a synchronous rotation protrusion 440 having a shape corresponding to the third vertical protrusion of the coupling edge portion 210 may be formed on a lower outer circumferential surface of the lifting tube 400. In addition, by arranging the third vertical protrusion of the coupling edge portion 210 to be engaged between the synchronous rotation protrusions 440, the lower cap 200 and the lifting tube 400 may rotate synchronously.

The rotating portion 300 may have a cylindrical shape of which at least a portion of an interior is formed to be hollow to pass from an upper surface to a lower surface. A lower portion of the rotating portion 300 is coupled to the inside of the lower cap 200 and may rotate synchronously according to the rotation of the lower cap 200. For example, as described above, by arranging the plurality of first vertical protrusions formed on the inner circumferential surface of the lower cap 200 and the plurality of second vertical protrusions formed on the outer circumferential surface of the rotating portion 300 to be engaged, the rotating portion 300 may rotate synchronously with the rotation of the lower cap 200.

An inner edge portion 310 that protrudes inward from an inner circumferential surface of the rotating portion 300 for coupling with the lifting tube 400 may be formed in the rotating portion 300. For example, the inner edge portion 310 may be coupled to a second coupling portion 430 of the lifting tube 400. In this case, the inner edge portion 310 may be formed of an annular protrusion, a groove, a step, or a combination thereof, but is not limited thereto, and various coupling methods may be applied in some embodiments of the present disclosure.

In an embodiment, an outer edge portion 320 that protrudes along the outer circumferential surface of the rotating portion 300 may be formed in the rotating portion 300. When the rotating portion 300 and the lower cap 200 are coupled, a lower surface of the outer edge portion 320 may be seated on the upper end of the lower cap 200. Additionally, when the upper cap 700 and the rotating portion 300 are coupled, a lower portion of the upper cap 700 may be seated on an upper surface of the outer edge portion 320.

The lifting tube 400 is coupled to the inside of the rotating portion 300 to enable synchronous rotation, allowing the lifting part 500 to move vertically. The lifting tube 400 may have a shape of which an interior has a hollow to pass from the upper surface to the lower surface and may be disposed to surround at least a portion of the lifting part 500 from the outside.

One or more lifting protrusions 410 may be formed on an inner surface of the lifting tube 400. The lifting protrusion 410 moves along a guide protrusion 521 of the lifting part 500 by rotation of the manipulating parts 200, 300, and 400 or the rotating portion 300, thereby moving the lifting part 500 upward or downward.

In an embodiment, the outer surface of the lifting tube 400 may be provided with the first coupling portion 420 coupled to the second stepped portion 120 of the housing 100 and the second coupling portion 430 coupled to the inner edge portion 310 of the rotating portion 300. For example, when the lifting tube 400 is coupled to the housing 100 and the rotating portion 300, the first coupling portion 420 may be caught on an upper end of the second stepped portion 120, the second coupling portion 430 may be caught on a lower portion of the inner edge portion 310. Accordingly, while the lifting tube 400 rotates synchronously with the rotating portion 300, the position thereof may be fixed. Here, the first coupling portion 420 and the second coupling portion 430 may be formed of an annular protrusion, a groove, a step, or a combination thereof, but are not limited thereto.

The synchronous rotation protrusion 440, which is engaged with the coupling edge portion 210 of the lower cap 200, may be formed on an outer circumferential surface (particularly, a lower side of the second coupling portion 430) of the lifting tube 400. For example, the synchronous rotation protrusion 440 may be provided as a plurality of protrusions in a vertical direction. The synchronous rotation protrusion 440 is disposed to engage with the plurality of third vertical protrusions formed on the inner circumferential surface of the coupling edge portion 210 as described above, and thus the lifting tube 400 may rotate synchronously with the rotation of the lower cap 200.

The lifting part 500 is coupled to the inside of the housing 100 and rotates synchronously with the housing 100 to accommodate and/or support at least a portion of the contents. Additionally, the lifting part 500 moves vertically inside the housing 100 according to the rotation of the manipulating parts 200, 300, and 400, thereby exposing the contents to the outside of the housing 100 or accommodating the contents inside the housing 100.

The lifting part 500 may include a supporting part 510 and a rod portion 520.

The supporting part 510 is formed in a plate shape with a predetermined thickness and disposed inside the housing 100 to support the contents from the lower side of the housing 100. For example, a lower portion of the contents may be seated on an upper surface of the supporting part 510, and the remaining portion may be accommodated in the housing 100.

One or more accommodating grooves 511 corresponding to the wing portions 620 of the operating part 600 may be formed at the upper end of the supporting part 510. Accordingly, when a position of the operating part 600 is lowered from a first coupling position (a position where an upper end of the operating part 600 is spaced upward a predetermined distance from an upper end of the lifting part 500) and changed to a second coupling position, at least portions of a plurality of wing portions 620 may be accommodated in the corresponding accommodating groove 511.

In an embodiment, a through hole 512 may be formed in the one or more accommodating grooves 511. In this case, the through hole 512 may be formed at a position corresponding to an extending protrusion 621 of the operating part 600. Accordingly, when the position of the operating part 600 changes from the first coupling position to the second coupling position, an extending protrusion 621 may descend along the through hole 512.

The coupling relationship between the supporting part 510 and the operating part 600 will be described in more detail below.

The rod portion 520 is formed to extend downward from a lower portion of the supporting part 510, and at least a portion thereof may be accommodated inside the lifting tube 400. In addition, since a hollow passes through the rod portion 520 in a vertical direction, the hollow communicating with the supporting part 510 may be formed therein. Through the hollow, at least a portion of the operating part 600 (particularly, at least a portion of a body portion 610) may be accommodated inside the rod portion 520.

The guide protrusion 521 may be formed on an outer surface of the rod portion 520. For example, guide protrusions 521 may be formed consecutively along an outer surface from a point at a lower portion of the rod portion 520 to a point at an upper portion to form a spiral shape. The lifting protrusion 410 formed on the lifting tube 400 moves along the guide protrusions 521 by rotation of the manipulating parts 200, 300, and 400, and thus the lifting part 500 moves vertically inside the housing 100.

The operating part 600 is coupled to the lifting part 500 such that the upper end thereof is spaced upward a predetermined distance from the upper end of the lifting part 500 at the first coupling position, thereby supporting the contents together with the lifting part 500.

The operating part 600 may include the body portion 610 and the wing portions 620.

The body portion 610 is a portion forming the body of the operating part 600, and at least a portion thereof may be inserted into and coupled to the lifting part 500. For example, the body portion 610 is formed to correspond to the hollow of the rod portion 520, and at least a portion including the lower portion may be inserted into the hollow of the rod portion 520.

In an embodiment, a first locking protrusion 611 may be formed along a lower outer circumferential surface of the body portion 610. As the body portion 610 is inserted into the hollow of the rod portion 520, a second locking protrusion 513 formed on an upper inner circumferential surface of the lifting part 500 and the first locking protrusion 611 are engaged. Accordingly, the operating part 600 and the lifting part 500 may be coupled so that the upper end of the operating part 600 (particularly, the wing portions 620) is spaced a predetermined distance from the upper end of the lifting part 500.

In an embodiment, one or more elastic pieces 612 may be formed on an outer circumferential surface of the body portion 610. The elastic piece 612 may be formed by passing through the outer circumferential surface of the body portion 610 to the inside thereof in a predetermined shape. For example, a lower portion of the elastic piece 612 and an interconnected through area between both sides thereof are disposed so that the elastic piece 612 may be elastically deformed based on a connection portion of an upper end thereof.

In an embodiment, a third locking protrusion 613, which is engaged with an upper end surface of the lifting part 500 at the first coupling position, may be formed on a lower outer surface of the elastic piece 612. Specifically, when the operating part 600 is in the first coupling position, the third locking protrusion 613 is caught on the upper end surface of the lifting part 500, and the first locking protrusion 611 formed in the lower portion of the body portion 610 may be fastened to the second locking protrusion 513. Accordingly, until a certain amount of external force acts on the operating part 600, the operating part 600 may maintain the first coupling position (i.e., a position spaced a predetermined distance from the upper end of the lifting part 500). However, it is not limited thereto, and in some embodiments of the present disclosure, the elastic piece 612 may not be formed on an outer surface of the body portion 610. In this case, the operating part 600 may be supported by the contents filling between the supporting part 510 and the operating part 600 (in particular, the wing portions 620).

The wing portion 620 is provided on an upper end of the body portion 610 and supports the lower side of the contents together with the supporting part 510. When a certain amount of the contents are used, the wing portion 620 is exposed to the outside and receives a user's external force. At least portions of the wing portions 620 may be disposed separately upward from the upper end of the lifting part 500 at the first coupling position and accommodated in the accommodating groove 511 of the lifting part 500 at the second coupling position.

The wing portions 620 may be formed to protrude outward from an upper circumference of the body portion 610. In this case, the wing portions 620 may be formed as a plurality of wing portions 620 and disposed separately along the upper circumference of the body portion 610. Accordingly, the wing portions 620, together with the body portion 610 and the upper end of the lifting part 500, may firmly support the contents in various directions.

In an embodiment, an extending protrusion 621 that protrudes downward from one area (e.g., an outer end) may be formed on one or more wing portions 620. The extending protrusion 621 is inserted into the through hole 512 of the supporting part 510 to guide the coupling of the operating part 600 and prevent the rotation thereof.

In an embodiment, the through hole 512 may be formed at a location corresponding to an upper circumference of the lifting tube 400. Accordingly, depending on the coupling of the operating part 600 and the lifting part 500, the extending protrusion 621 inserted into the through hole 512 may be aligned to correspond to the upper circumference of the lifting tube 400.

Through this structure, when the operating part 600 and the lifting part 500 are first assembled on the lifting tube 400, an upper end of the lifting tube 400 may serve as a pedestal to automatically position the operating part 600 at the first coupling position. That is, when the lifting part 500 coupled to the operating part 600 is inserted into the lifting tube 400 and lowered maximally, the upper circumference of the lifting tube 400 supports a lower portion of the extending protrusion 621 upward, and thus the operating part 600 may naturally be positioned as the first coupling position. In this state, contents may fill a space inside the housing 100 on an upper side of the supporting part 510 through the outlet of the housing 100.

In an embodiment, the upper cap 700 serves to protect the contents accommodated inside the housing 100 from being exposed to the outside. The upper cap 700 is coupled to cover the outlet of the housing 100, thereby protecting the contents accommodated inside the housing 100 from contamination. The upper cap 700 may be detachably coupled to the outer surface of the housing 100 and/or the manipulating parts 200, 300, and 400 and may be detached therefrom by a user. In order to increase the coupling force of the upper cap 700, the outer surface of the housing 100 and/or the manipulating parts 200, 300, and 400 (particularly, an outer surface of the rotating portion 300) may be provided with a step, a protrusion, or a locking protrusion. etc., but this is only an example. In addition, various structures for attaching and detaching the upper cap 700 may be applied.

FIGS. 4A to 5B are views for explaining an operation of the operating part according to an embodiment of the present disclosure.

Referring to FIGS. 4A to 5B, the operating part 600 is coupled to the upper end of the lifting part 500 and may be lowered from the first coupling position to the second coupling position depending on the user's external force.

First, at the first coupling position, the upper end of the operating part 600 may be spaced upward a predetermined distance from the upper end of the lifting part 500. For example, in the operating part 600, as the lower portion of the body portion 610 is inserted into the lifting part 500 at the first coupling position so that the first locking protrusion 611 is engaged with the second locking protrusion 513 of the lifting part 500, the third locking protrusion 613 may be caught on the upper end surface of the lifting part 500. Accordingly, the upper end of the operating part 600 may be disposed separately upward from the upper end of the lifting part 500.

Afterward, when a user applies an external force to the operating part 600 (particularly, the wing portions 620) at the first coupling position, the elastic piece 612 is elastically deformed inward, thereby causing the third locking protrusion 613 to deviate inward from the upper end surface of the lifting part 500, and the operating part 600 may be lowered and changed to the second coupling position. In this case, at the second coupling position, the wing portions 620 are accommodated in the accommodating groove 511, and at the same time, the elastic piece 612 presses an inner circumferential surface of the lifting part 500, and thus the operating part 600 may stably maintain the second coupling position.

FIGS. 6A to 7B are views for explaining how to use a stick content container according to an embodiment of the present disclosure.

Figure 6A:
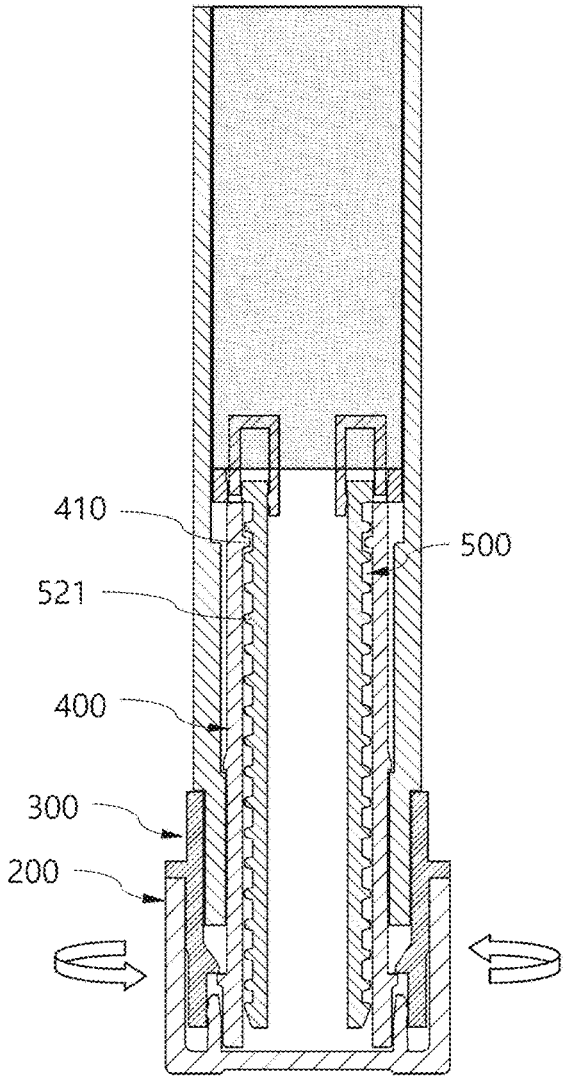
FIGS. 6A to 7B are views for explaining how to use a stick content container according to an embodiment of the present disclosure.
Figure 6B:
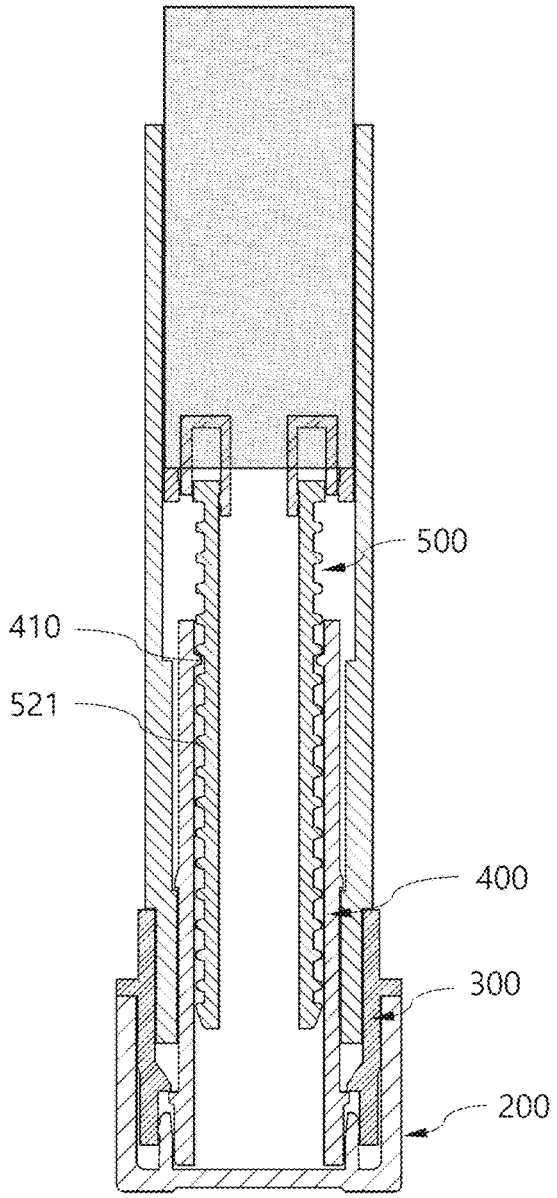

First, referring to FIGS. 6A and 6B, a user may raise the lifting part 500 so that the contents are exposed to the outside through an open upper surface of the housing 100. For example, when the user rotates the lower cap 200 relative to the housing 100 in the first direction, the lifting protrusion 410 provided inside the lifting tube 400 may move along the guide protrusion 521 of the lifting part 500. Accordingly, as the lifting part 500 rises, contents move upward and become exposed to the outside through the open upper surface of the housing 100, and the user may apply the externally exposed contents to the skin or the like.

After the user uses the contents, when the lower cap 200 is relatively rotated in the second direction while holding the housing 100 and/or the lower cap 200, the rotating portion 300 and the lifting tube 400 also rotate synchronously in the second direction, and the lifting protrusion 410 may move relative to the guide protrusion 521. Accordingly, as the lifting part 500 descends, the contents may be accommodated and stored inside the housing 100.

Figure 7A:
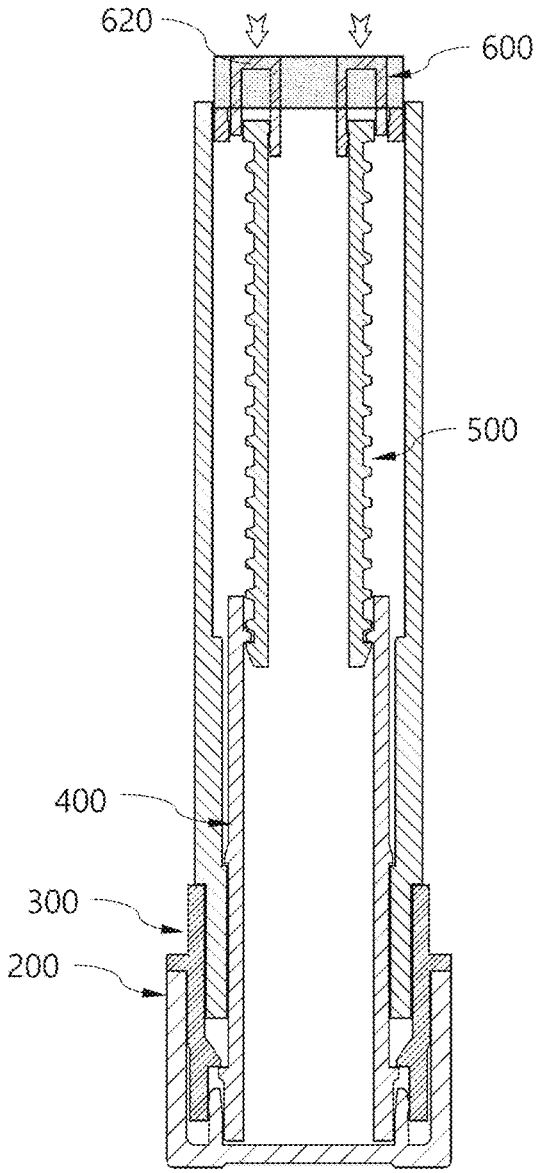
Figure 7B:
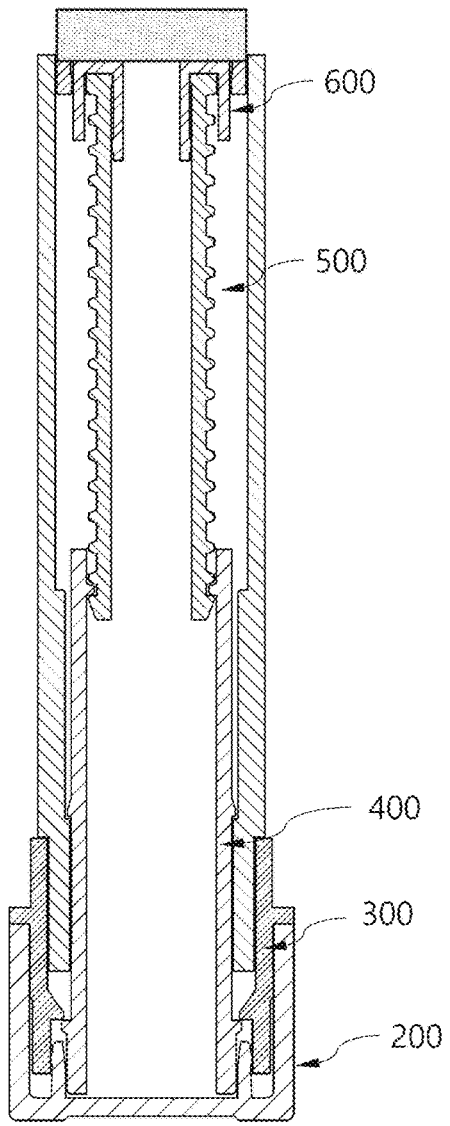

Referring to FIGS. 7A and 7B, when contents are used beyond a certain amount, at least a portion of the operating part 600 (in particular, the wing portions 620) (e.g., an upper surface of the wing portions 620) may be exposed to the outside (e.g., the upper surface of the used contents). In this case, when a portion of the wing portions 620 are exposed to the outside, a user may move the operating part 600 to the second coupling position by pressing the exposed wing portions 620 downward. Accordingly, the operating part 600 supporting the contents is accommodated inside the lifting part 500 and the contents may be used without any remaining contents.

Figure 8B:
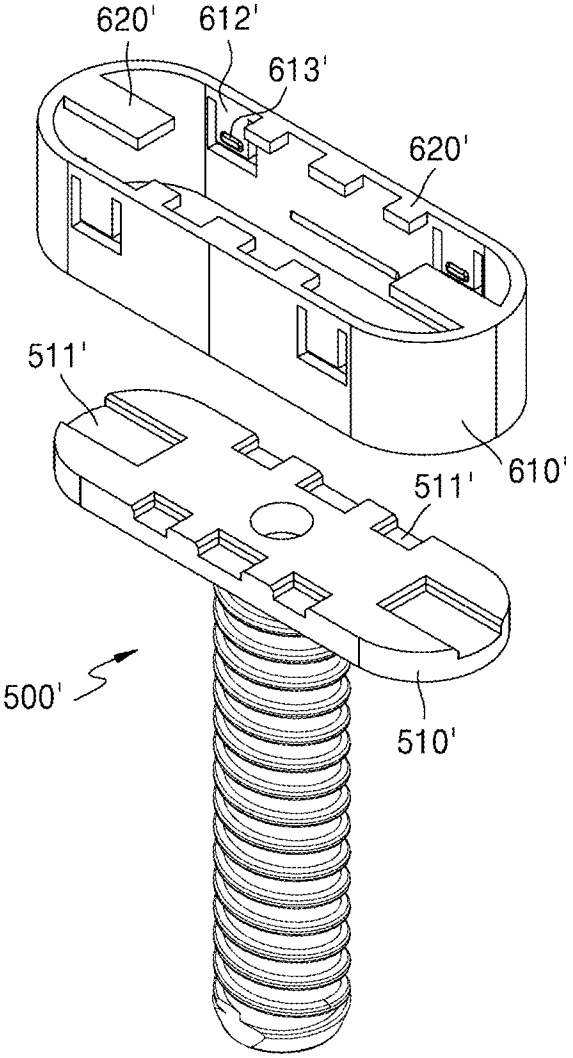
FIGS. 8A and 8B are views for explaining a lifting part and an operating part of a stick content container according to another embodiment of the present disclosure.
Figure 8A:
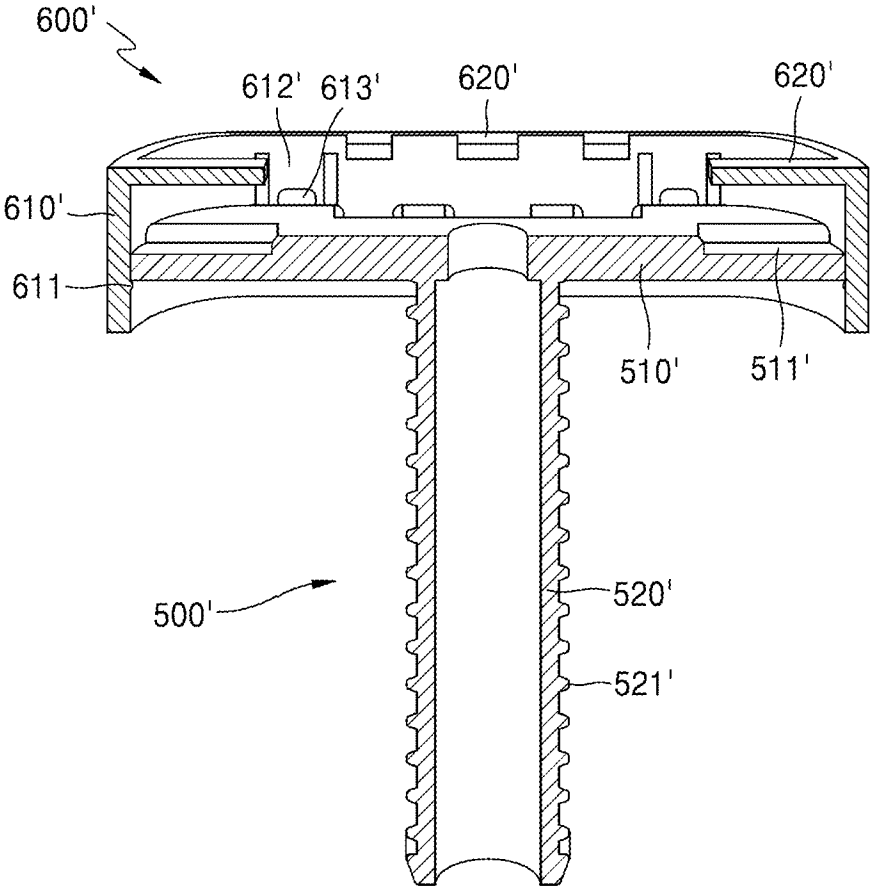

FIGS. 8A and 8B are views for explaining a lifting part and an operating part of a stick content container according to another embodiment of the present disclosure.

Referring to FIGS. 8A and 8B, an operating part 600' may be coupled to surround an outer side of an upper end (in particular, a supporting part 510') of a lifting part 500'.

The first locking protrusion 611' is formed along an inner circumferential surface of a lower portion of a body portion 610', and a third locking protrusion 613' may be formed on an inner surface of a lower portion of an elastic piece 612'. When an upper end of the operating part 600' is in a first coupling position spaced a predetermined distance from an upper end of the lifting part 500', the third locking protrusion 613' of the operating part 600' is caught on the upper end surface of the supporting part 510, and the first locking protrusion 611' may be caught on a lower surface of the supporting part 510'. Accordingly, the operating part 600' may maintain the first coupling position until a certain amount of external force acts on the operating part 600'. When a user's external force is applied to the operating part 600' (particularly, the wing portions 620') at the first coupling position, the elastic piece 612' is deformed elastically outward, the third locking protrusion 613' deviates from the upper end surface of the supporting part 510' and goes over an edge portion of the supporting part 510', and the operating part 600' may be lowered and changed to the second coupling position.

The wing portion 620' may be formed to protrude inward from an upper circumference of the body portion 610'. In this case, the wing portion 620' may be formed as a plurality of wing portions 620 which are disposed separately along an upper circumferential of the body portion 610'. Accordingly, the wing portions 620', together with the upper end of the body portion 610' and the lifting part 500', may firmly support the contents in various directions.

A plurality of accommodating grooves 511' in which the wing portions 620' are accommodated at the second coupling position of the operating part 600' may be formed in an upper surface of the supporting part 510'.

In an embodiment, the supporting part 510' may be formed in a non-circular shape. In this case, an internal space of the housing 100 of the content container in which the lifting part 500' is accommodated may also be formed in the non-circular shape like that of the supporting part 510'. Accordingly, the lifting part 500' and the housing 100 may be connected to each other for synchronous rotation.

As described above, a stick content container according to the present disclosure firmly supports contents through an operating part, and when the contents are used beyond a certain amount, the operating part is lowered by external force so that the entire contents can be used without any remaining amount.

As described above, the exemplary embodiments are disclosed in the drawings and specifications. Although specific terms are used herein, these terms are used only for the purpose of explaining the present disclosure and are not used to limit the meaning or scope of the present disclosure as recited in the claims. Therefore, those skilled in the art will understand that various modifications and other equivalent embodiments are possible therefrom. Therefore, the true technical protection scope of the present disclosure should be determined by the technical spirit of the appended claims of the patent.

The invention claimed is:

1. A content container comprising:

a housing having an outlet disposed at an upper portion thereof;

a manipulating part coupled to a lower portion of the housing and configured to relatively rotate with the housing;

a lifting part having at least a portion thereof disposed inside the housing and configured to vertically move according to the rotation of the manipulating part; and an operating part coupled to the lifting part and having an upper end thereof spaced upward at a predetermined distance from an upper end of the lifting part at a first coupling position, wherein the operating part is configured to support contents together with the lifting part, and wherein the operating part is configured to be exposed to an outside according to use of the contents and to be lowered from the first coupling position to a second coupling position by a user's external force applied to an exposed area of the operating part.

2. The content container of claim 1, wherein:

the operating part comprises a body portion coupled to the upper end of the lifting part, and one or more wing portions disposed to protrude outward or inward from an upper circumference of the body portion, wherein at least a portion of the operating part is disposed separately upward from the upper end of the lifting part at the first coupling position; and the contents are supported by the upper end of the lifting part and the one or more wing portions at the first coupling position.

3. The content container of claim 2, wherein one or more accommodating grooves corresponding to the one or more wing portions are disposed at the upper end of the lifting part, and when the operating part is at the second coupling position, at least portions of the one or more wing portions are accommodated in the one or more accommodating grooves.

4. The content container of claim 3, wherein a lower portion of the body portion is inserted into and coupled to the lifting part, and the one or more wing portions protrude outward from the upper circumference of the body portion.

5. The content container of claim 4, wherein an extending protrusion protrudes downward from one area of the one or more wing portions, and a through hole into which the extending protrusion is configured to be inserted is formed in the one or more accommodating grooves.

6. The content container of claim 4, wherein:

a first locking protrusion is disposed a lower outer circumferential surface of the body portion; and a second locking protrusion configured to engage with the first locking protrusion at the first coupling position is disposed on an upper inner circumferential surface of the lifting part.

7. The content container of claim 6, wherein an elastic piece is disposed through an outer circumferential surface of the body portion in a predetermined shape, and a third locking protrusion configured to engage with an upper end surface of the lifting part at the first coupling position is disposed on a lower outer surface of the elastic piece.

8. The content container of claim 7, wherein, when the user's external force is applied to the one or more wing portions exposed to the outside by use of the contents, the elastic piece is elastically deformed inward, the third locking protrusion is separated from the upper end surface of the lifting part, and the operating part descends to the second coupling position.

9. The content container of claim 8, wherein:

a guide protrusion protrudes along an outer circumferential surface of the lifting part;

the manipulating part comprises a lifting tube into which the lifting part is inserted, and one or more lifting protrusions are formed on an inner circumferential surface of the lifting tube; and when the manipulating part rotates, the one or more lifting protrusions moves relative to the guide protrusion of the lifting part and moves the lifting part upward or downward.

* * * * *